US007814646B2

(12) United States Patent
Tarpill et al.

(10) Patent No.: US 7,814,646 B2
(45) Date of Patent: Oct. 19, 2010

(54) TOOL FOR COMPRESSING A CONNECTOR WITH SLIDING CARRIAGE

(75) Inventors: Andrew J. Tarpill, East Haddam, CT (US); Tadeusz Zagula, Hartford, CT (US)

(73) Assignee: Capewell Components Company, LLC, Cromwell, CT (US)

( * ) Notice: Subject to any disclaimer, the term of this patent is extended or adjusted under 35 U.S.C. 154(b) by 429 days.

(21) Appl. No.: 11/930,459

(22) Filed: Oct. 31, 2007

(65) Prior Publication Data

US 2009/0106971 A1 Apr. 30, 2009

(51) Int. Cl.
*H01R 43/042* (2006.01)
*H01R 9/05* (2006.01)

(52) U.S. Cl. ..... 29/751; 29/747; 29/748; 29/753; 29/764; 439/578

(58) Field of Classification Search ..... 29/751, 29/747, 748, 749, 764, 753, 827; 81/355, 81/352, 57.38; 72/409.14, 410; 439/578, 439/583, 584, 629, 628
See application file for complete search history.

(56) References Cited

U.S. PATENT DOCUMENTS 3,820,420 A 6/1974 Matthews
4,718,460 A * 1/1988 Sato ..... 140/93.2
5,138,864 A 8/1992 Tarpill
5,596,800 A * 1/1997 Holliday et al. ..... 29/751
5,934,137 A 8/1999 Tarpill
5,997,350 A * 12/1999 Burris et al. ..... 439/585
6,112,404 A 9/2000 Tarpill
6,293,004 B1 * 9/2001 Holliday ..... 29/751
6,820,326 B1 11/2004 Tarpill et al.
7,210,327 B1 5/2007 Tarpill et al.

* cited by examiner

*Primary Examiner*—Derris H Banks
*Assistant Examiner*—Tai Nguyen
(74) *Attorney, Agent, or Firm*—DeLio & Peterson, LLC

(57) ABSTRACT

A compression assembly hand tool for attaching a connector to a coaxial cable tool includes a sliding carriage driven by handles through multiple stages of mechanical advantage to provide a very high level of compression assembly force in order to compress large diameter connectors. The middle and the back of a connector are engaged between relatively closely spaced, parallel, and opposed compression surfaces on the front of the tool and on the sliding carriage. Adapter inserts that slide into openings in the compression surfaces allow different connector sizes to be compressed. The tool allows the cable to extend outward from either end so that splice connectors may be attached. In the preferred design, a ratcheting system using two pawls provides the very highest level of compression force.

10 Claims, 7 Drawing Sheets

TOOL FOR COMPRESSING A CONNECTOR WITH SLIDING CARRIAGE

BACKGROUND OF THE INVENTION

1. Field of the Invention

The present invention relates to hand tools for attaching an electrical connector to the prepared end of a coaxial cable. More specifically, the present invention relates to hand tools that apply a very high level of compression force to the connector in a direction parallel to the axis of the connector and to hand tools that can be used to compress connectors of different sizes.

2. Description of Related Art

Coaxial cable is widely used to distribute radio and television signals, digital data and the like over large distribution networks. Large diameter coaxial cable is typically used in the main distribution links, with progressively smaller diameter cable being used as the ends of the distribution network are approached.

Connectors are attached at the ends of every coaxial cable link and large connectors are needed for the largest cables. One type of connector that is available is attached to the coaxial cable by applying a compression force to the connector parallel to the axis of the connector. This type of connector is designed with two parallel and opposed planar surfaces that are engaged by corresponding opposed planar compression surfaces on the hand tool.

As the handles of the tool are squeezed together, the compression surfaces on the hand tool move towards each other and apply a compression force to the connector. Typically, the compression force acts to move two parts of the connector into engagement or to collapse a portion of the connector into engagement with the coaxial cable.

Relatively high levels of compression force are needed to reliably attach large connectors and it is difficult for an installer to supply the necessary level of force when a conventionally designed hand tool is used. A hand tool capable of applying a very high level of compression force to the connector while requiring only limited hand force to operate the tool is needed for reliably attaching large connectors to large diameter coaxial cable.

Coaxial cable connectors come in a variety of sizes to match the different sizes of cables. A hand tool capable of attaching different sizes of connectors, particularly large diameter connectors, is needed to minimize the number of tools that must be carried by the installer.

To ensure reliable attachment of the connector to the coaxial cable it is important that the parallel planar surfaces of the connector remain parallel at all times as the hand tool squeezes those surfaces towards each other. If the compression tool allows the opposed compression surfaces to become misaligned as they move towards each other, the connector will not be properly compressed.

Prior art tools have difficulty in maintaining the correct parallel alignment. It is particularly difficult to maintain the correct alignment when applying very high compression forces, as needed for the largest connectors. A hand tool capable of accurately maintaining parallel alignment between the compression surfaces when applying high levels of compression force to large connectors is needed.

Even if the compression assembly tool is well designed to hold the compression surfaces in accurate parallel alignment, the connector must be accurately placed between the compression surfaces in the tool so that the axis of the connector is perpendicular to the plane of the compression surfaces. In addition, the connector must remain perpendicular to those surfaces throughout the compression cycle.

The farther apart the compression surfaces on the tool are when the compression cycle starts, the harder it is for the connector to be placed in the correct perpendicular alignment, and the easier it is for the connector to slip out of correct alignment during the compression cycle.

Existing compression assembly tool designs typically have a wide separation between the compression surfaces. These tools engage the connector at the front and back of the connector requiring a wide separation between the compression surfaces to accommodate the entire length of the connector. A hand tool with compression surfaces close together is desirable to ensure accurate initial placement of the connector between the compression surfaces and correct perpendicular connector alignment throughout the compression cycle.

In order to attach the largest connectors, which require the highest levels of compression force, prior art tools have conventionally been designed with very long handles. This requires clearance for the long handles to be operated and two hand operation. A tool capable of applying the required high levels of compression force with a single hand in a limited area would be desirable.

A related problem is that most prior art compression assembly tools can accept the connector to be compressed in only one direction. Typically, the coaxial cable must extend outward from the tool in a predetermined direction relative to the motion of the handles. This may create clearance problems with the tool handles if a connection is required in a limited space. A tool capable of being reversed relative to the connector would also be desirable.

Yet another related problem is that conventional compression assembly tools cannot attach splice connectors where coaxial cables extend outward in opposite directions from the connector. A tool adaptable for compressing splice connectors would also be desirable.

SUMMARY OF THE INVENTION

Bearing in mind the problems and deficiencies of the prior art, it is therefore an object of the present invention to provide a compression assembly tool that requires low hand force while applying very high levels of compression force.

It is another object of the present invention to provide a compression assembly tool that can compress at least two different sizes of electrical connectors onto coaxial cables.

It is a further object of the invention to provide a compression assembly tool that maintains the axis of the connector in accurate perpendicular alignment to planar compression surfaces on the tool.

It is yet another object of the present invention to provide a compression assembly tool that minimizes the distance between planar compression surfaces to ensure accurate initial placement of the connector and correct alignment throughout the compression cycle.

Still other objects and advantages of the invention will in part be obvious and will in part be apparent from the specification.

The above and other objects, which will be apparent to those skilled in the art, are achieved in the present invention which is directed to a tool for compressing a connector to attach the connector to a coaxial cable. The tool includes a tool body having a linear guide and a first compression surface that supports the connector during compression. The first compression surface includes an opening, preferably U-shaped, that allows the coaxial cable to extend outward therefrom.

A sliding carriage moves within the tool body along the linear guide in linear sliding motion towards and away from the first compression surface. The sliding carriage includes a second compression surface that faces the first compression surface. As the carriage slides, the second compression surface moves with it towards and away from the first compression surface.

The tool includes first and second handles that drive the sliding carriage to compress the connector between the compression surfaces. The handles are mounted to the tool body and move relative to each other between an open position and a closed position. The handles drive a link that is pivotally connected to the sliding carriage at one end. In one preferred aspect of the invention, the link is pivotally connected to a ratchet at an opposite end. The ratchet is pivotally attached to the tool body and the link drives the sliding carriage in sliding motion as the ratchet pivots relative to the tool body.

The ratcheted tool includes at least one pawl engaging the ratchet that is driven by the first handle to incrementally pivot the ratchet relative to the tool body and drive the sliding carriage as the handles are repeatedly moved between the open and closed positions.

In the most highly preferred embodiment, the tool further includes a second pawl that engages the ratchet to hold the ratchet in a fixed position relative to the tool body as the handles are moved to the open position. This allows the handles to drive the ratchet with the first pawl as they are closed and the second pawl to hold the ratchet as the handles are opened and brought to the next ratchet tooth.

In another aspect of the invention, the ratchet includes first and second sets of teeth. The first set of teeth is engaged by the first pawl and the second set of teeth is engaged by the second pawl. The teeth may be separated by a notch that allows the second pawl to pivot into engagement with the ratchet when the notch is aligned with the second pawl.

In yet another aspect of the invention, the first pawl may include a back end that contacts a pin on the tool when the handles are opened fully. The pin rotates the first pawl to disengage the first pawl from the ratchet when the handles are opened beyond the normal open position.

In still another aspect of the invention, the tool body includes a pair of opposed plates and the linear guide is formed as opposed slots in the plates. The sliding carriage includes opposed flanges that extend outward from the sides of the carriage and into the opposed slots in the plates to provide engagement between the sliding carriage and the linear guide. The slots act as tracks that control and guide the motion of the sliding carriage in accurate sliding motion during the compression cycle.

In a further aspect of the invention, the tool further includes one or more inserts that allow the tool to be used with other sizes of connectors. The inserts are preferably U-shaped and are sized to fit within and be engaged by the openings in the first and/or second compression surfaces. The inserts are supported by the first and second compression surfaces and provide replacement compression surfaces that contact the second size connector. Replacement openings in the replacement compression surfaces allow the coaxial cable and or the connector to extend outward therefrom.

Although the tool preferably uses a ratchet and pawl system to allow maximum compression force, the tool may directly drive the link with the handles instead of driving the ratchet. In this embodiment the handle may be directly attached to and directly drive the ratchet or the handle may replace the ratchet entirely by being pivoted where the ratchet would otherwise be pivoted. In this embodiment, the tool includes a tool body having a first compression surface for contacting the connector, the first compression surface having an opening allowing the coaxial cable to extend outward therefrom. The body is formed as an opposed pair of plates, and a linear guide having opposed tracks on the opposed pair of plates guides the sliding carriage. The opposed tracks are oriented perpendicular to the first compression surface.

First and second handles are mounted to the tool body and are movable relative to each other between an open position and a closed position. The sliding carriage has the second compression surface thereon oriented parallel to the first compression surface. The sliding carriage has opposed parallel sides in sliding contact between the opposed plates and engages the opposed tracks of the linear guide for sliding motion perpendicular to the first compression surface. The link is pivotally attached to the sliding carriage at one end and to a moving pivot at the opposite end, the moving pivot being driven by at least one of the handles as the handles are moved to the closed position to drive the sliding carriage and the second compression surface towards the first compression surface.

In yet another aspect of the invention, a tool according to the present invention allows the two compression surfaces to be very close together by engaging the middle of the connector and driving it towards the back end of the connector. By placing the two compression surfaces close together, a very accurate and stable compression is achieved as compared to a wide separation of the compression surfaces relative to the size of the connector. A tool according to this aspect of the invention includes a tool body and first and second handles mounted to the tool body and movable relative to each other between an open position and a closed position.

A sliding carriage is mounted to the tool body for sliding motion relative thereto as the handles move between the open and closed positions. The tool includes first and second compression surfaces for contacting the connector that move towards each other as the handles move between the open and closed positions to compress the connector.

In this embodiment, the first compression surface is fixed relative to the tool body. The second compression surface moves with the sliding carriage towards the first compression surface during compression as the handles drive the carriage. One of the compression surfaces engages the back end of the connector adjacent the opening for receiving the coaxial cable and includes an opening allowing the coaxial cable to extend therethrough, and the other of the compression surfaces engages the middle of the connector and includes an opening allowing the front end of the connector to extend therethrough.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5 shows the compression assembly tool in FIG. 1 in the starting position. The handles are open, the connector and cable have been inserted into the tool and are ready to be compressed. Compression not yet started.

FIG. 6 shows the handles closed from the position in FIG. 5. The connector has been partially compressed.

FIG. 7 shows the handles opened from the position in FIG. 6. The connector remains partially compressed to the level of compression seen in FIG. 6, but the handles are now open and are ready to begin another incremental ratchet compression step.

FIG. 8 shows the handles closed from the position in FIG. 7. The connector has been further incrementally compressed.

FIGS. 9 and 10 are similar to FIGS. 7 and 8 and show the final ratcheting steps of incremental compression. In FIG. 10 the connector has been fully compressed.

FIG. 11 shows the tool handles opened farther than in FIGS. 5-10. This releases the ratcheting mechanism.

FIG. 12 shows the ratcheting mechanism returned to the starting position to release the connector and prepare the tool for another compression cycle.

DESCRIPTION OF THE PREFERRED EMBODIMENT(S)

In describing the preferred embodiment of the present invention, reference will be made herein to FIGS. 1-12 of the drawings in which like numerals refer to like features of the invention.

Figure 2:
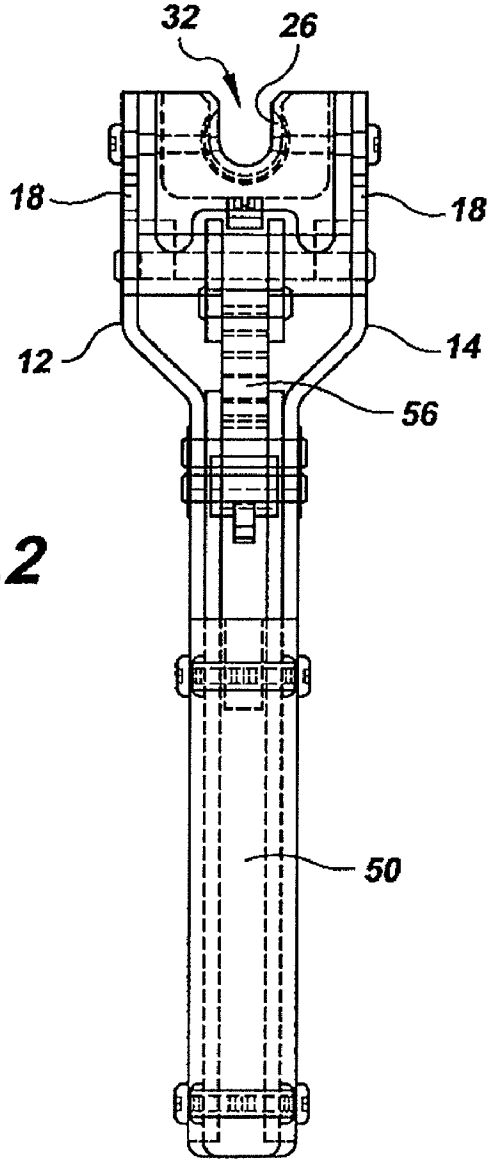
FIG. 2 is a front elevational view of the compression assembly tool in FIG. 1.
Figure 1:
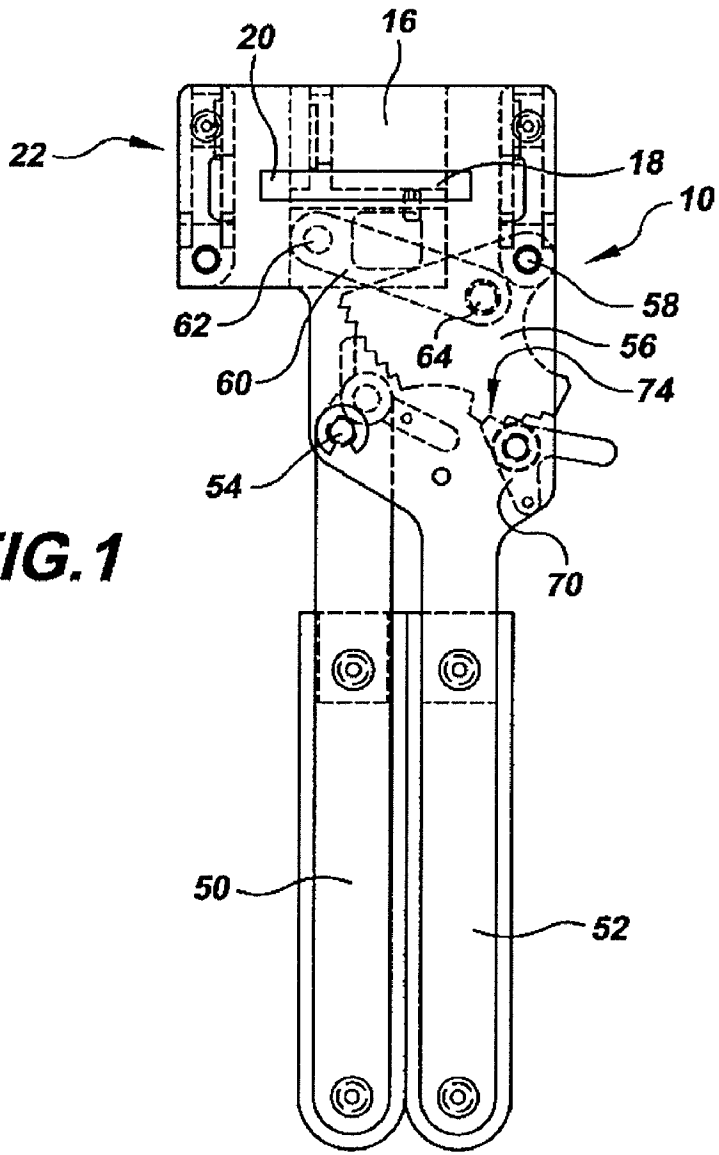
FIG. 1 is a left side elevational view of a compression assembly tool according to the present invention with portions of the tool being shown in phantom.
Figure 3:
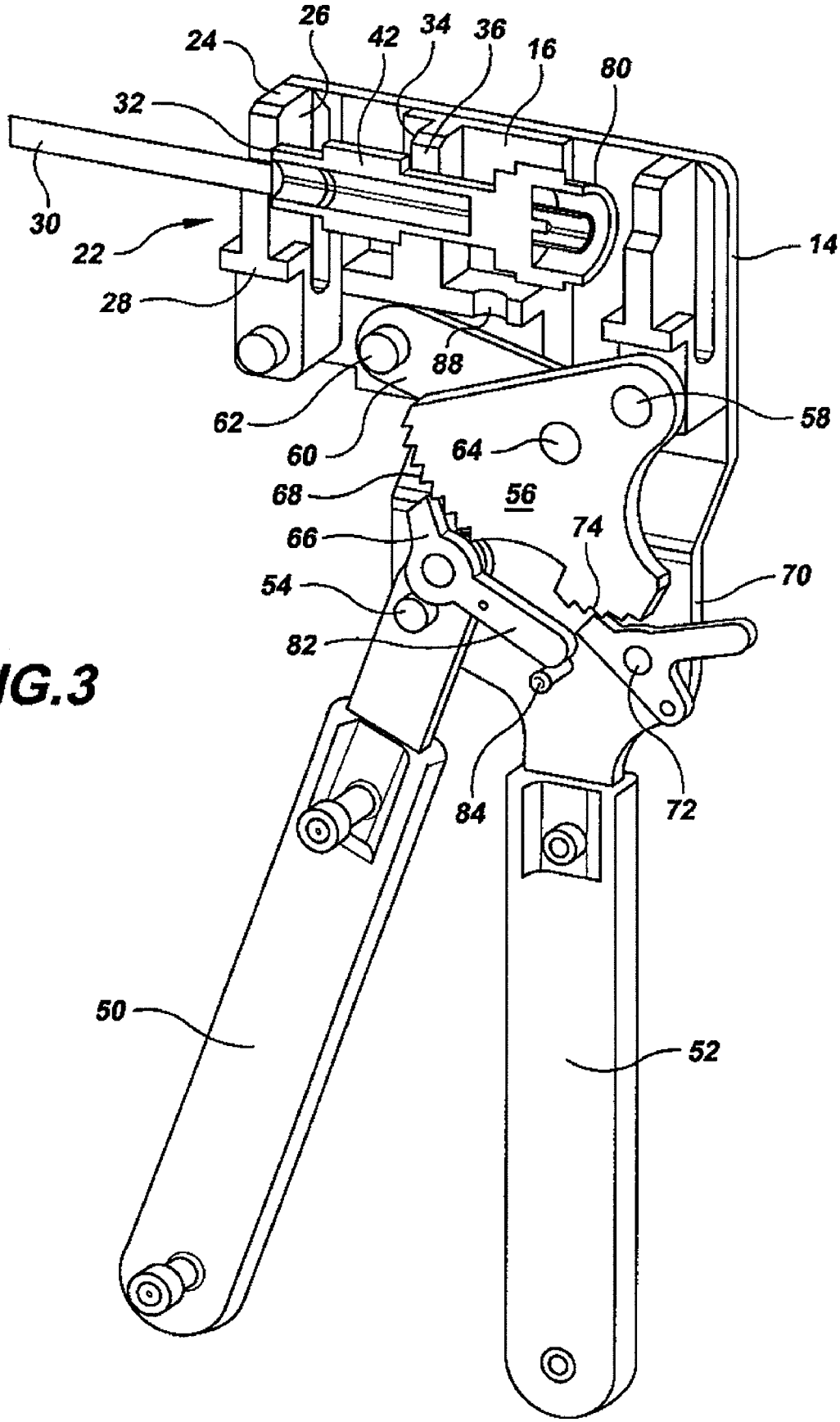
FIG. 3 is a left side perspective view of the compression assembly tool in FIG. 1 with portions of the tool being cut away. A partially compressed connector is shown within the tool and portions of the connector are cut away.

Referring to FIGS. 1-3, the present invention includes a tool body 10 that includes a pair of opposed plates 12, 14. A sliding carriage 16 is mounted between the plates and moves towards the front of the tool 22 as the handles 50, 52 are repeatedly cycled between the open and closed positions. A connector to be compressed is placed within the tool and is compressed between parallel compression surfaces located on the front end of the tool and the sliding carriage.

The sliding carriage 16 includes parallel opposed sides in sliding contact with the inner surfaces of the opposed plates 12, 14 forming the tool body. A pair of opposed flanges 18 project outward from the sides of the sliding carriage 16 and into captured engagement with opposed slots 20 formed in the body plates 12, 14.

The flanges 18 preferably run along the entire length of the sliding carriage. The slots 20 are longer than the flanges 18, allowing forward and backward motion of the flanges within the slots to allow forward and back motion of the sliding carriage. This design provides a linear guide for the sliding carriage with the opposed slots 20 forming opposed tracks that accurately hold and guide the carriage 16 as it slides relative to the front 22 of the tool.

By capturing the flanges 18 over the entire length of the sides of the sliding carriage 16, the sliding carriage 16 is required to move in a direction that is accurately held parallel to the centerline of the tool and the connector being compressed. The flanges prevent the carriage from pitching nose-down or nose up. The engagement between the flanges and slots further functions to prevent the carriage from moving down or up off the centerline, while the engagement between the sides of the carriage and the inner opposed surfaces of the plates 12, 14 prevents the carriage from moving left or right off the tool centerline and out of alignment during the compression cycle.

Referring to FIG. 3, it can be seen that the front of the tool 22 is formed by a block 24 that extends between the plates 12, 14 and accurately holds them the desired distance apart. The plates are held apart by a distance that corresponds closely to the width of the sliding carriage 16. Additional spacers at the back of the tool and along the bottom edge of the plates serve to hold the opposed plates accurately parallel. In the preferred design, the plates extend down and are bent closer together to hold a ratchet 56 and link 60 and to form handle 52.

An inner surface on the block 24 defines a first compression surface 26 that is perpendicular to the compression axis of the tool and which acts to support the back end 28 of a connector as it is compressed for attachment to coaxial cable 30. The coaxial cable 30 extends forward out of the tool through an opening 32 in the first compression surface 26. The opening 32 is preferably U-shaped, which allows the connector to be inserted into the tool with the back end of the connector against the perimeter of the opening 32 forming the first compression surface 26.

The sliding carriage 16 includes a corresponding opposed second compression surface 34, which is parallel to and faces the first compression surface 26. In the preferred design, the second compression surface 34 also includes a U-shaped opening 36 which allows the connector to project through the compression surface 34 towards the rear of the tool.

The position of a connector is shown in FIG. 3 where the cable extends out the front of the tool and the connector is located within the tool. The back end of the connector is supported by the first compression surface and a ring located at the middle of the connector is supported for compression by the second compression surface on the sliding carriage.

Figure 4:
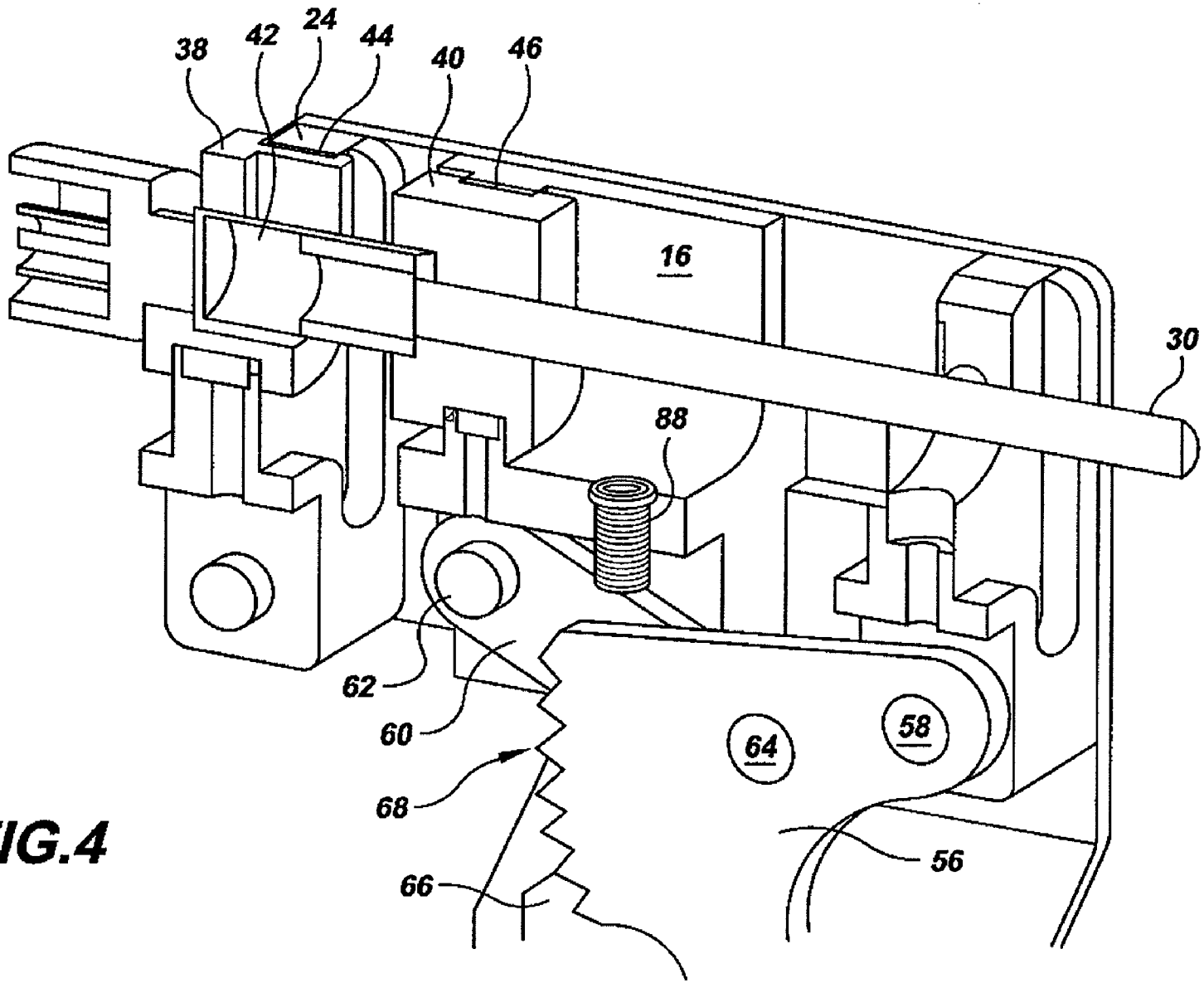
FIG. 4 is also a left side perspective view of the upper end of the compression assembly tool in FIG. 1. The view is similar to the cut-away view in FIG. 4 except that compression inserts have been placed into the tool to adapt the tool to compress a different size connector. It will also be noted that in this view the direction of the cable and connector has been reversed showing that the cable may extend from either side to accommodate splice connectors or for clearance of the handles during the compression cycle.

As can be seen by reference to FIG. 4, in the preferred design, the connector and coaxial cable may be reversed, with the cable extending out the back end of the tool. This allows connectors to be compressed in either direction. FIG. 4 also illustrates the use of U-shaped inserts 38, 40, which may be placed into the U-shaped openings in the first and second compression surfaces. The inserts 38, 40 have an exterior that is U-shaped to fit within the U-shaped openings 32, 36, and a smaller U-shaped interior that receives a connector having a smaller diameter. The inserts 38, 40 have a U-shaped groove 44, 46 on their U-shaped exterior that fits accurately within and engages the U-shaped openings in the corresponding compression surfaces.

The present tool is particularly suitable for compressing very large connectors that have a front connector piece for making an electrical connection and a back connector piece that surrounds the cable and is compressed into the back end of the front connector piece to make electrical connection.

As is shown in FIGS. 3 and 4, it is preferred that the first and second compression surfaces 26 and 34 be relatively close to one another such that one of the compression surfaces acts against the back connector piece with the coaxial cable 30 extending outward therethrough while the other compression surfaces acts on the middle of the connector against an enlarged ring 42 formed at the back end of the front connector piece.

It will be understood that by placing the opposed compression surfaces close to one another and compressing the middle of the connector against the back of the connector the connector is less likely to move out of alignment with the compression axis or to tilt relative to the compression surfaces during the compression operation. This design also keeps the tool relatively compact.

The tool includes a pair of handles 50, 52 that move between open and closed positions. A first handle 50 swings on pivot 54 so that it can move outward and away from the fixed handle 52. The fixed handle is preferably formed as part of the opposed plates forming the body of the tool The tool also includes a ratchet 56 that rotates relative to the body of the tool on pivot 58. A link 60 is connected at one end via pivot 62 to the sliding carriage 16 and at the opposite end via pivot 64 to the ratchet 56. Because pivot 58 is fixed relative to the body of the tool, as the ratchet 56 rotates counter-clockwise it swings to the right and pulls the link 60 and the sliding carriage 16 to the right with it. As the ratchet 56 rotates clockwise, it moves to the left and pushes the sliding carriage towards the front of the tool compressing the connector.

In order to achieve the very high levels of force required for the large connectors compressed by this tool, a series of three mechanical leverages are used, with each providing progressively greater mechanical advantage.

The first mechanical advantage is provided by the fact that the pivot point 64, which connects to link 60, lies midway between the pivot 58 and the toothed perimeter of the ratchet 56. As force is applied to the teeth 68, 74 on the perimeter of the ratchet 56, that force is multiplied before being applied to the end of the link 60.

The second mechanical advantage is provided by handle 50, which drives a first pawl 66. Handle 50 rotates on pivot 54. The length of handle 50 on the far side of pivot 54 is much greater than distance from the pivot 54 to the toothed perimeter of the ratchet. This relationship multiplies the force applied to the handle before applying it to the toothed perimeter of the ratchet 56

The third mechanical advantage is provided by the link 60 and the location of pivot 64 between pivots 58 and 62. The pivot 64 must move farther to reach the line between pivots 62 and 58 than the sliding carriage and pivot 62 must move to allow this motion. Force applied to pivot 64 by the first two stages of mechanical advantage is multiplied again by this third stage of force multiplication.

Although the first two stages of mechanical leverage advantages described above may be sufficient in some embodiments of the invention to achieve compression, particularly where the first handle 50 is directly connected to pivot 58 to drive the link pivot 64, in the preferred embodiment the third mechanical advantage is required to achieve the very highest levels of compression force.

Because of the multiple stages of mechanical advantage, the handle 50 can only drive the sliding carriage a very short distance in a single swinging motion from open to closed. To achieve full compression, the handle 50 must be cycled through multiple swings to compress the connector with a ratcheting compression cycle.

The ratcheting mechanism includes ratchet 56, first pawl 66, and second pawl 70, which rotates on pin 72. The first pawl 66 engages a first set of teeth 68 on the perimeter of the ratchet and the second pawl 70 engages a second set of teeth 74 on the ratchet 56. The pin 72 is stationary relative to the tool body and functions with the second pawl 70 to hold the ratchet 56 when the first handle 50 is opened for each cycle to move the first pawl 66 to a new tooth on the first set of teeth 68.

The operation of the tool in its ratcheting motion to compress a connector will now be described with reference to FIGS. 5-6 which show multiple steps within the ratcheting compression operation of the tool.

Figure 5:
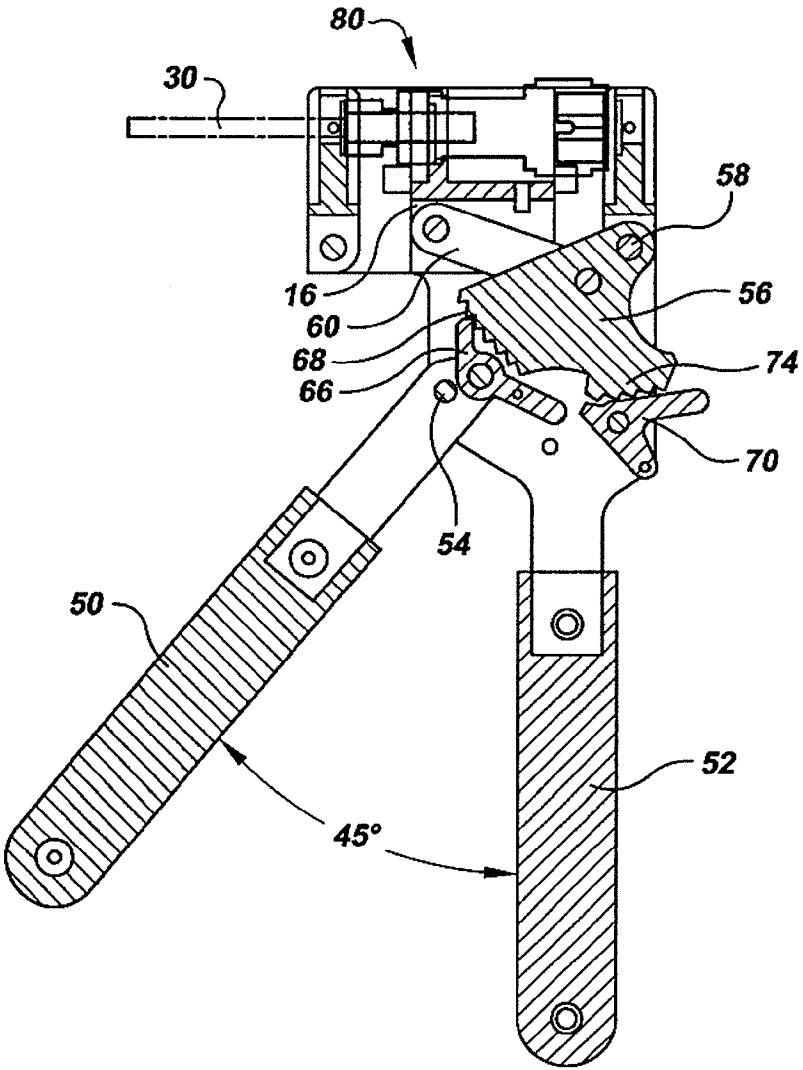

FIG. 5 shows the tool with a connector 80 inserted into the tool such that the coaxial cable 30 extends forward through the first compression surface. The middle of the connector is engaged by the second compression surface on the sliding carriage. The sliding carriage 16 is at its maximum distance from the first compression surface on the front of the tool to accommodate the uncompressed connector 80.

To start the compression operation, the first handle 50 has been brought forward to the open position and forms an angle of approximately 45° relative to the second handle 52. The ratchet 56 is rotated to a maximum counter-clockwise position relative to pivot 58 to bring the sliding carriage 16 as far from the front of the tool as possible. The first pawl 66 is spring biased into engagement with one of the teeth in the first set of teeth 68. The second pawl 70, which is also spring biased, has not yet engaged the second set of teeth 74 on the ratchet 56.

Figure 6:
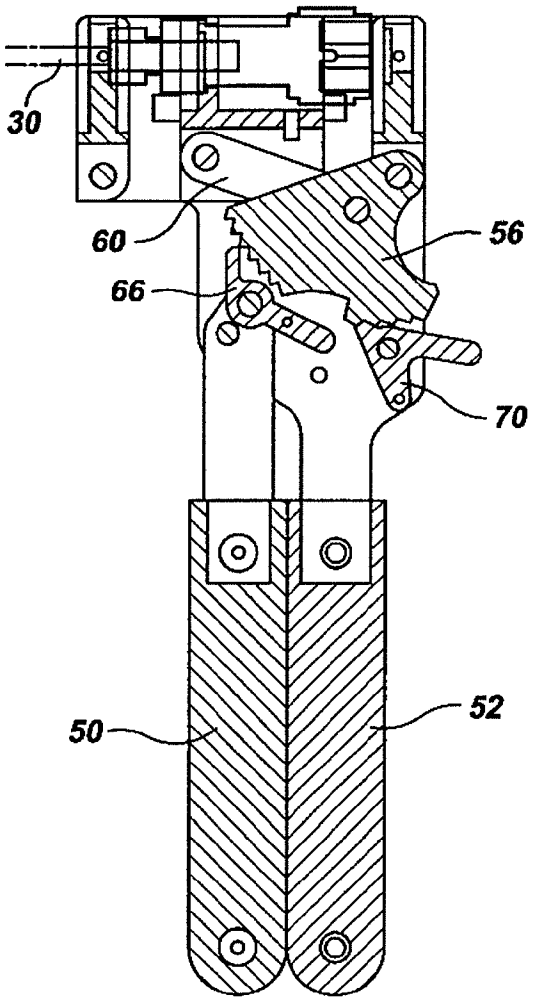
FIGS. 5-12 show the compression assembly tool in FIG. 1 in a progressive sequence during a ratcheting compression cycle as the handles are repeatedly opened and closed.

The handle 50 is now swung to the closed position seen in FIG. 6. As the handle 50 rotates about pivot 54 pawl 66 drives the ratchet 56 to rotate clockwise about pivot 58. At the end of the swing, as handle 50 reaches the closed position, the spring biased second pawl 70 drops into engagement with the second set of teeth. The first handle 50 is now free to rotate back to the open position.

The second pawl 70 holds the ratchet 56 in the position reached in FIG. 6 as the handle 50 swings open. The spring biased first pawl 66 drops over and engages the next tooth in the first set of teeth when the handle 50 is open by approximately 37° as shown in FIG. 7.

A tool user's hand is strongest as the hand approaches the closed position. By allowing the next tooth to be engaged at the limited opening angle of 37°, the tool user can grip the handles with greater force and compress the handles more easily because the handles are relatively closer together. The handles need not be opened to an extreme angle before they can be squeezed together to apply force for the next ratcheting step.

Figure 8:
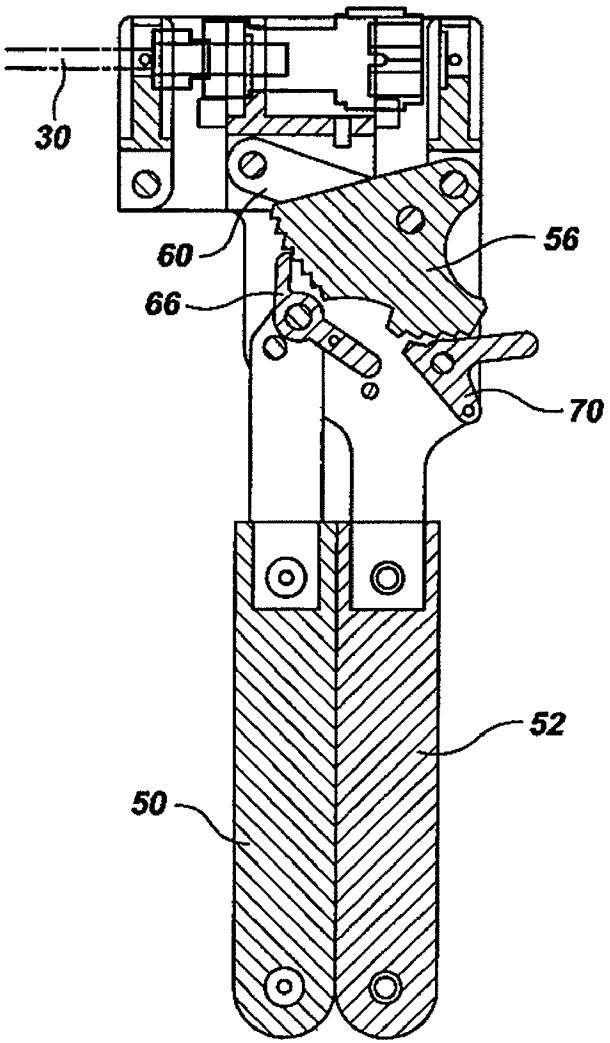
Figure 7:
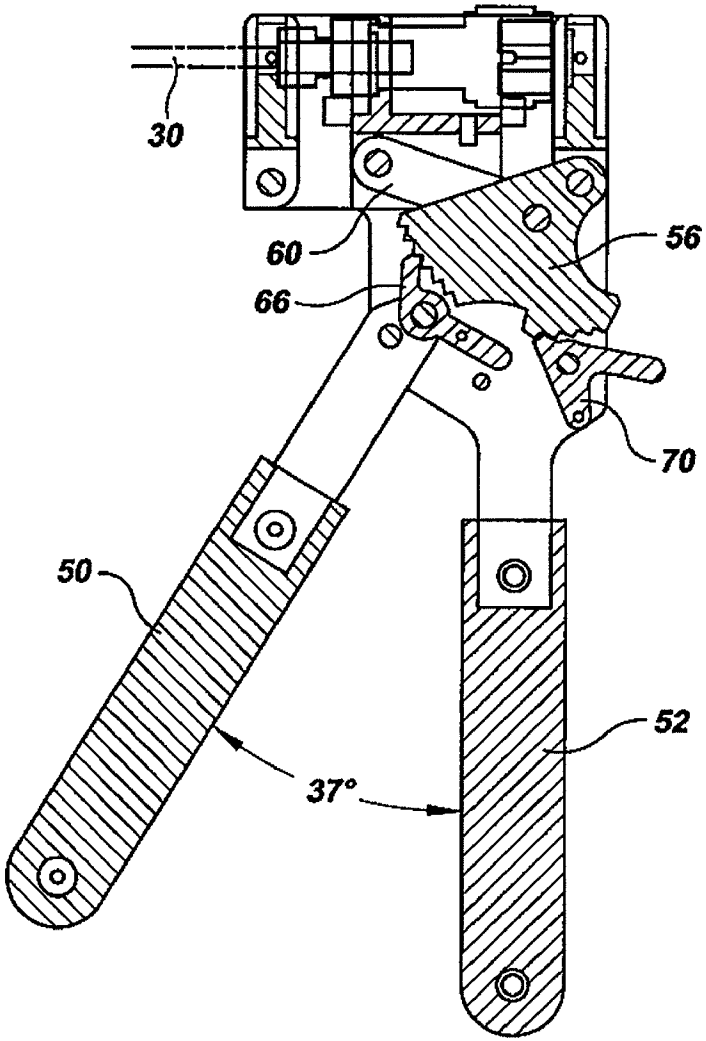
Figure 10:
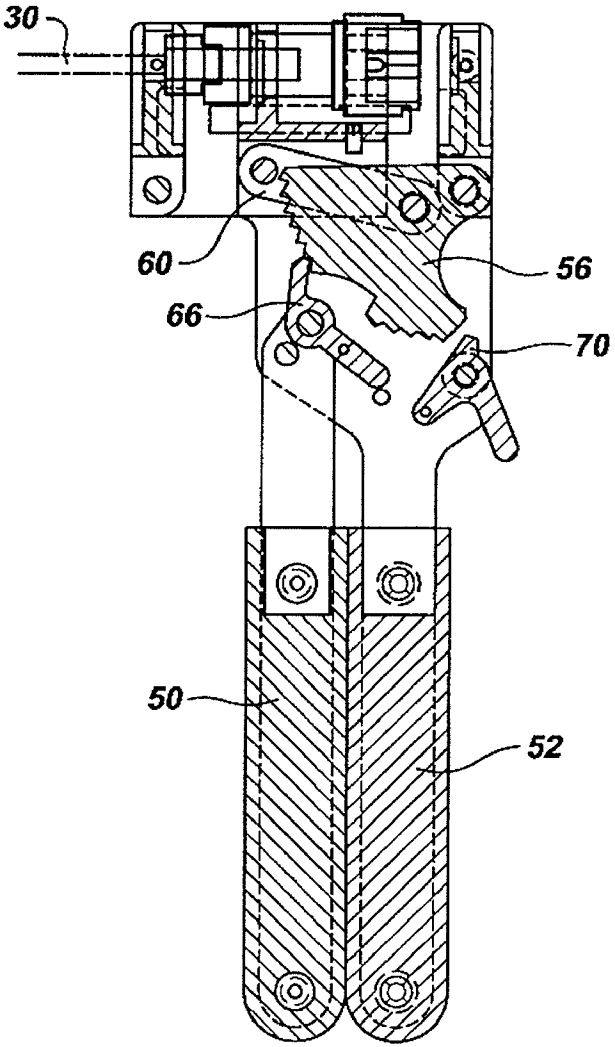

Once the first pawl 66 has engaged the next tooth as shown in FIG. 7, the handles are compressed again and brought to the closed position seen in FIG. 8. This causes the second pawl to drop into engagement with its next tooth on the second set of teeth, which holds the ratchet in position for the handles to be opened again. This cycle is repeated for each tooth on the first set of teeth of the ratchet with the first pawl driving the ratchet one tooth in the clockwise direction and the second pawl holding the ratchet for repositioning of the handles.

Figure 9:
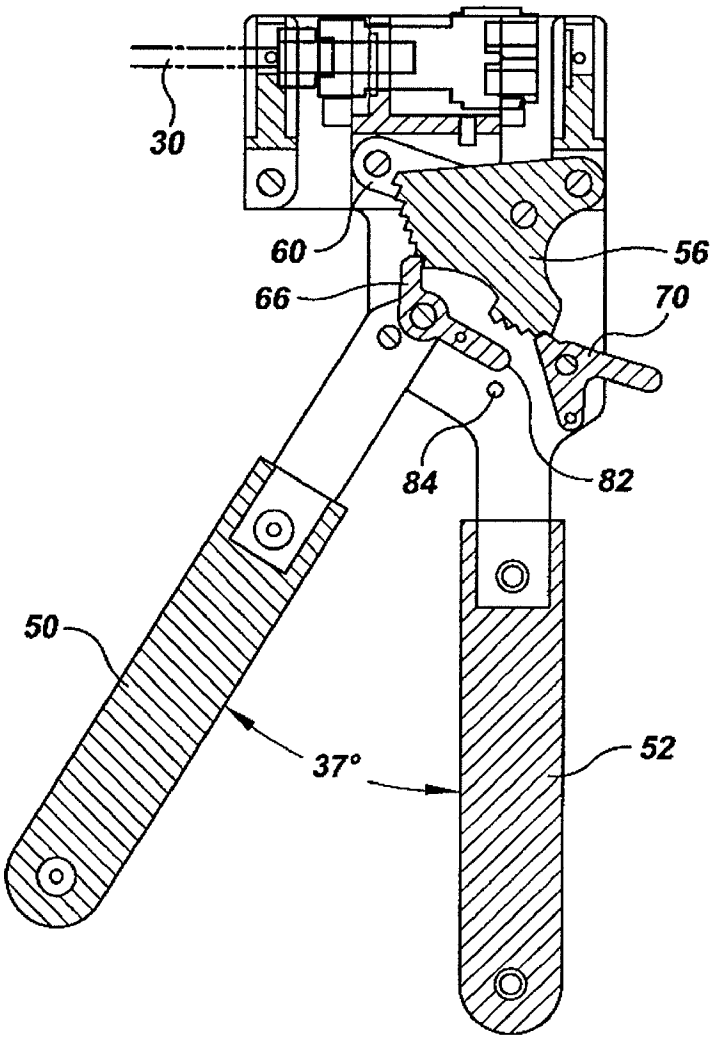
Figure 12:
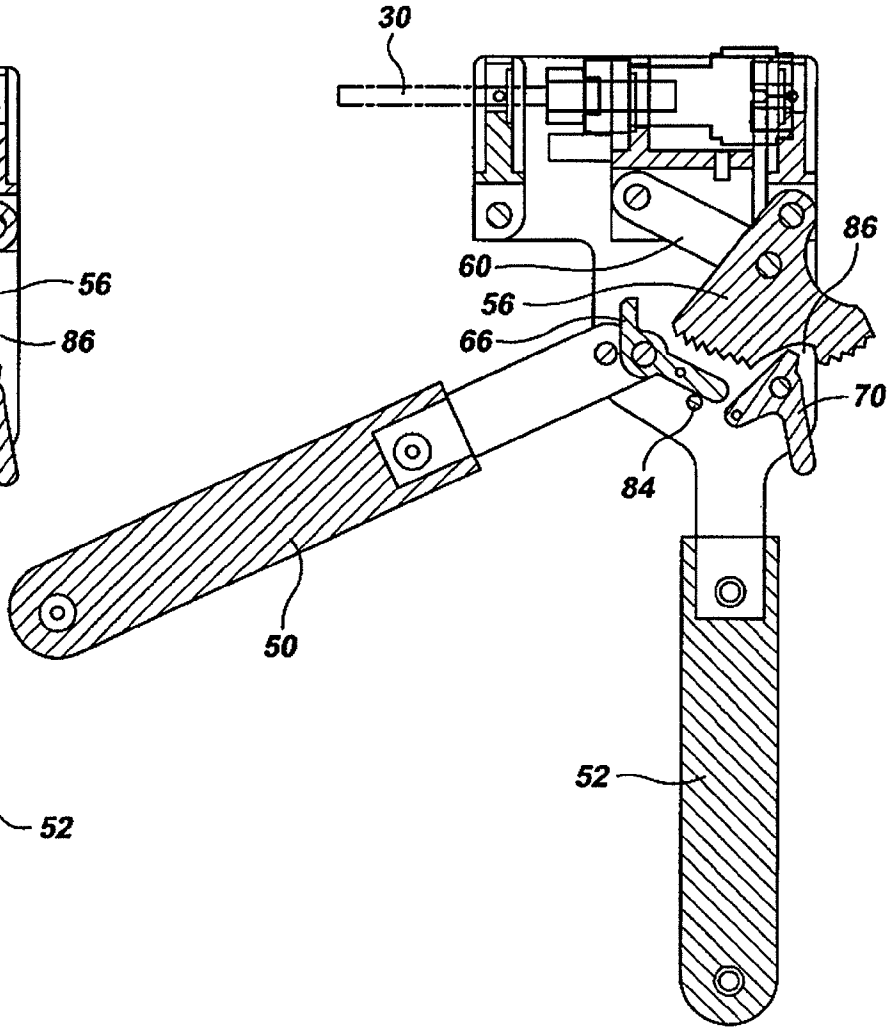

After several cycles of this ratcheting operation, the first pawl reaches the last tooth on the first set of teeth as shown in FIG. 9. At this point the second pawl has reached the last tooth in the second set of teeth. As the handles are swung towards the closed position of FIG. 10, the second pawl 70 drops off the last tooth in the second set of teeth 74 and the compression of the connector is complete. The ratchet 56 has reached its maximum clockwise rotation position and the sliding carriage has reached its maximum forward position.

Figure 11:
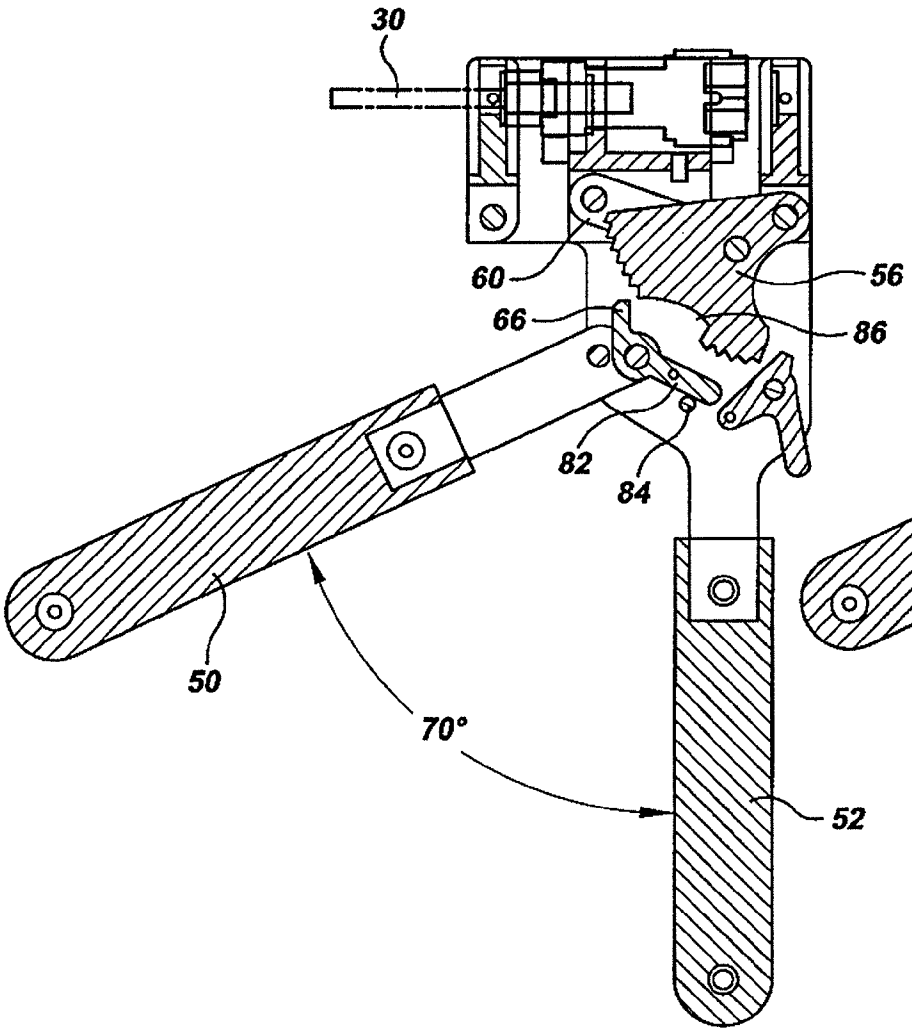

At this point, the tool needs to be opened. To release the first pawl from the ratchet, the first handle 50 is swung well beyond the normal open position to an angle of 70° as seen in FIG. 11. The second pawl 70 includes a back end 82 which contacts a fixed pin 84 causing the front end of the first pawl 66 to disengage from the ratchet 56. The second pawl was previously disengaged as it dropped off the back end of the ratchet. The carriage is now free to slide to the opened position as the ratchet 56 rotates counter-clockwise.

As the ratchet 56 rotates, notch 86, which is located between the first and second sets of teeth on ratchet 56, provides clearance for the second pawl 70 to swing back into position to begin engaging the second set of teeth. The entire compression cycle is now complete. The first handle 50 can be swung open to reach the position of FIG. 5 and the tool is now ready to compress a new connector.

Referring again to FIGS. 3 and 4, a threaded stop 88 limits the motion of the link 60 to control and adjust the final location of the sliding carriage. This adjusts the final position of the sliding carriage to ensure complete compression and compensate for tool wear.

Referring to FIG. 4, the first and second inserts may be lifted out to accommodate large diameter connectors and/or different sizes of inserts can be dropped into the U-shaped openings of the first and second compression surfaces to accommodate different shapes and sizes of connectors and/or to allow connectors to be reversed.

Each insert is supported against the compression force by the compression surface associated with the opening holding the insert. Each insert provides a replacement compression surface that directly contacts the connector and each defines a replacement that allows the coaxial cable or connector to extend through the replacement compression surface.

Because the front and back ends of the tool are open, the coaxial cable can extend out in either direction. This allows the tool to be reversed when working space is limited. Alternatively, the tool may be used to attach splice connectors, where the coaxial cable extends out from both ends of the tool.

A related feature which allows the tool to be used in small and confined spaces relates to the fact that the handles only need to swing open a limited distance to reach the next tooth on the ratchet 56. Preferably this distance is only 37 degrees. Due to the multiple mechanical advantages, the handles can be relatively short while still supplying very high levels of compression force.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A tool for compressing a connector to attach the connector to a coaxial cable comprising:

a tool body including:

a linear guide, and a first compression surface for contacting the connector, the first compression surface including an opening allowing the coaxial cable to extend outward therefrom;

a sliding carriage engaging the linear guide for linear sliding motion towards and away from the first compression surface, the sliding carriage including a second compression surface for contacting the connector, the second compression surface moving with the sliding carriage towards and away from the first compression surface;

first and second handles mounted to the tool body and movable relative to each other between an open position and a closed position;

a ratchet pivotally attached to the tool body;

a link pivotally connected to the sliding carriage at one end and pivotally connected to the ratchet at an opposite end, the link driving the sliding carriage in sliding motion as the ratchet pivots relative to the tool body;

at least one pawl engaging the ratchet and driven by the first handle to incrementally pivot the ratchet relative to the tool body and drive the sliding carriage as the handles are repeatedly moved between the open and closed positions.

2. The tool for compressing a connector according to claim 1 wherein the at least one pawl is a first pawl and the tool further includes a second pawl, the second pawl engaging the ratchet to hold the ratchet in a fixed position relative to the tool body as the handles are moved to the open position.

3. The tool for compressing a connector according to claim 2 wherein the ratchet includes first and second sets of teeth, and the first set of teeth is engaged by the first pawl and the second set of teeth is engaged by the second pawl.

4. The tool for compressing a connector according to claim 1 wherein the at least one pawl is a first pawl and the tool further includes a second pawl, the second pawl engaging the ratchet to hold the ratchet in a fixed position relative to the tool body as the handles are moved to the open position during a compression cycle and the second pawl pivoting off an end of the ratchet at the end of the compression cycle to release the ratchet.

5. The tool for compressing a connector according to claim 4 wherein the ratchet includes a first set of teeth engaged by the first pawl and a second set of teeth engaged by the second pawl and a notch between the first and second sets of teeth, the notch allowing the second pawl to pivot into engagement with the ratchet when the notch is aligned with the second pawl.

6. The tool for compressing a connector according to claim 1 further including a pin and wherein the first pawl includes a back end contacting the pin when the handles are opened fully to disengage the first pawl from the ratchet.

7. The tool for compressing a connector according to claim 1 wherein:

the tool body includes a pair of opposed plates;

the linear guide is formed as opposed slots in the plates; and the sliding carriage includes opposed flanges extending into the opposed slots in the plates to provide engagement between the sliding carriage and the linear guide.

8. The tool for compressing a connector according to claim 1 further including an insert adapted for a second size connector, the insert being sized to fit within and be engaged by the opening in the first compression surface and providing a first replacement compression surface for contacting the second size connector, the insert having a first replacement opening allowing the coaxial cable to extend outward therefrom.

9. The tool for compressing a connector according to claim 8 further including a second insert adapted for the second size connector, the second insert being carried by the sliding carriage and providing a second replacement compression surface for contacting the second size connector.

10. The tool for compressing a connector according to claim 9 wherein the second insert includes a second replacement opening allowing the coaxial cable to extend outward therefrom.

* * * * *